US006435923B1

(12) United States Patent
Ferguson

(10) Patent No.: US 6,435,923 B1
(45) Date of Patent: Aug. 20, 2002

(54) TWO SPEED TRANSMISSION WITH REVERSE FOR A WATERCRAFT

(75) Inventor: Arthur R. Ferguson, Glenview, IL (US)

(73) Assignee: Bombardier Motor Corporation of America, Grant, FL (US)

( * ) Notice: Subject to any disclaimer, the term of this patent is extended or adjusted under 35 U.S.C. 154(b) by 3 days.

(21) Appl. No.: 09/613,093

(22) Filed: Jul. 10, 2000

Related U.S. Application Data

(63) Continuation-in-part of application No. 09/543,437, filed on Apr. 5, 2000, now Pat. No. 6,305,997.

(51) Int. Cl.[7] ..... B63H 5/125
(52) U.S. Cl. ..... 440/75
(58) Field of Search ..... 440/75, 111; 475/271, 475/280, 317, 323

(56) References Cited

U.S. PATENT DOCUMENTS

| | | | | |
|---|---|---|---|---|
| 3,368,517 A | * | 2/1968 | MacDonald et al. | 440/57 |
| 3,919,964 A | | 11/1975 | Hagen | |
| 3,977,356 A | | 8/1976 | Kroll | |
| 3,994,254 A | | 11/1976 | Woodfill | |
| 4,276,034 A | | 6/1981 | Kashmerick | |
| 4,323,354 A | * | 4/1982 | Blanchard | 440/75 |
| 4,395,240 A | | 7/1983 | Blanchard | |
| 4,397,198 A | | 8/1983 | Borgersen et al. | |
| 4,428,734 A | | 1/1984 | Ludlow | |
| 4,451,238 A | | 5/1984 | Arnold | |
| 4,459,873 A | * | 7/1984 | Black | 74/720 |
| 4,558,769 A | | 12/1985 | Neisen | |
| 4,820,209 A | | 4/1989 | Newman | |
| 4,829,846 A | | 5/1989 | DeSalvo et al. | |
| 4,850,911 A | | 7/1989 | Nakahama et al. | |
| 4,861,295 A | | 8/1989 | McElroy, Jr. et al. | |
| 4,863,406 A | | 9/1989 | Bland et al. | |
| 4,867,717 A | | 9/1989 | Burmeister et al. | |
| 4,887,984 A | | 12/1989 | Newman | |
| 4,919,009 A | | 4/1990 | Newman et al. | |
| 4,940,434 A | * | 7/1990 | Kiesling | 440/57 |
| 4,969,370 A | | 11/1990 | Hayasaka | |
| 5,018,996 A | | 5/1991 | Newman et al. | |
| 5,108,324 A | | 4/1992 | Adams et al. | |
| 5,711,742 A | | 1/1998 | Leinonen et al. | |
| 5,836,067 A | | 11/1998 | Cochran | |

OTHER PUBLICATIONS

MerCruiser's Black Trac Transmission, Jim Barron, Jul. 1998.

* cited by examiner

*Primary Examiner*—Ed Swinehart

(57) ABSTRACT

A two-speed transmission (30) with reverse gearing for a watercraft (10). The transmission is disposed in the gimbal housing (25) passing through the transom (14) of the watercraft. A pair of planetary gears (46,80) share a common ring gear (40) to provide both forward-reverse and first-second gearing in a very compact package. The transmission housing may be formed in two portions, a first housing (32) containing the forward-reverse gear mechanisms and a second housing (62) containing the first-second gear mechanism. The transmission output shaft (64) is connected to the drive shaft (122) of a vertical drive unit (24) by a double universal joint (74) that may be replaced without disassembling the transmission components.

28 Claims, 4 Drawing Sheets

TWO SPEED TRANSMISSION WITH REVERSE FOR A WATERCRAFT

This application is a continuation-in-part of U.S. patent application Ser. No. 09/543,437 filed on Apr. 5, 2000, now U.S. Pat. No. 6,305,997.

BACKGROUND OF THE INVENTION

The present invention relates generally to the field of watercraft, and more particularly to the field of marine propulsion systems, and specifically to a two speed transmission with forward-reverse gearing for a watercraft wherein the transmission housing forms the gimbal housing of an in-board/out-board drive unit.

In conventional single speed marine drives, an engine is mechanically coupled to a propeller either directly or through a gear box to provide a single gearing ratio. It is known that a single gear ratio connection between the engine and propeller will provide less than optimal performance for many applications. There have been efforts to improve the performance of marine propulsion systems by the use of multi-speed and hydraulically coupled transmissions. It is known that the performance of a watercraft may be improved by providing a higher gear ratio connection between the engine and the propeller for low speed operation and acceleration, and by providing a direct drive or overdrive gear ratio between the engine and the propeller for high speed operation. In this manner, the engine may be operated at a point closer to its peak power output during a wider range of operating conditions.

U.S. Pat. No. 5,711,742 issued on Jan. 27, 1998, to Leinonen, et. al., incorporated by reference herein, describes a multi-speed marine propulsion system with an automatic shifting mechanism. An automatic transmission is interposed between the engine and the in-board/out-board drive apparatus. Although providing improved performance when compared to prior art single speed propulsion systems, the device of Leinonen creates an excessively long drive line which necessitates the placement of the engine in a more forward position within the watercraft hull than may otherwise be desirable.

U.S. Pat. No. 4,820,209 issued on Apr. 11, 1989, to Newman, incorporated by reference herein, describes a marine propulsion system having a fluid coupling with a variable power output. While this system avoids the long drive line of the Leinonen apparatus, it does so at the expense of multi-speed gear ratios. In lieu of multi-speed gears, the device of Newman provides for a controlled slippage between the engine and the propeller in order to improve low speed watercraft operation. The hydraulic coupling and forward-reverse gearing of the Newman transmission are enclosed within a housing passing through the transom of the watercraft, which in turn connects to the vertical drive unit containing the propeller. The device of Newman fails to provide a direct mechanical connection between the engine and the propeller at a plurality of gearing ratios.

BRIEF SUMMARY OF THE INVENTION

Thus, there is a particular need for an improved multi-speed mechanical drive transmission for a watercraft. Accordingly, a transmission for a watercraft is described herein as including: a first housing adapted for attachment to a motor; an input shaft rotatably supported by the first housing; a first housing output gear rotatably supported by the first housing; a forward-reverse shifting apparatus supported in the first housing for selective engagement between the input shaft and the first housing output gear in one of a forward and a reverse directions; a second housing attached to the first housing; an output shaft rotatably supported by the second housing; and a connection between the first housing output gear and the output shaft for providing rotation of the output shaft in response to rotation of the first housing output gear.

One embodiment of such a transmission is disclosed herein as including a housing; a input shaft rotatably supported by the housing; a output shaft rotatably supported by the housing; a first sun gear attached to and concentric with the input shaft for rotation therewith; a ring gear; a first planetary gear engaged between the first sun gear and the ring gear, the first planetary gear having a axis of rotation affixed to a carrier; a forward clutch disposed between the input shaft and the carrier and operable for selective engagement therebetween; a reverse clutch disposed between the housing and the carrier and operable for selective engagement therebetween; a second sun gear; a second planetary gear engaged between the second sun gear and the ring gear, the second planetary gear attached to the output shaft for rotation therewith; a first gear clutch disposed between the sun gear and the housing and operable for selective engagement therebetween; a second gear clutch disposed between the output shaft and the sun gear for selective engagement therebetween.

A marine propulsion apparatus is described herein as having: an engine having an output; a first housing attached to the engine; an input shaft rotatably supported by the first housing; a first sun gear attached to and concentric with the input shaft for rotation therewith; a ring gear; a first planetary gear engaged between the first sun gear and the ring gear, the first planetary gear having a axis of rotation affixed to a carrier; a forward clutch disposed between the input shaft and the carrier and operable for selective engagement therebetween; a reverse clutch disposed between the housing and the carrier and operable for selective engagement therebetween; a second housing adapted for attachment to the first housing; an output shaft rotatably supported by the second housing and operatively connected to the ring gear for rotation therewith; a vertical drive housing attached to the second housing; a drive shaft rotatably supported by the vertical drive housing and attached to the output shaft; and a propeller connected to the drive shaft.

The transmission described herein may be incorporated into a watercraft including: a hull having a transom; an engine disposed within the hull and having an output; a gimbal housing attached to the engine and passing through the transom; a vertical drive housing rotatably attached to the gimbal housing; a transmission comprising a first-second gear shifting apparatus disposed within the gimbal housing, the transmission having an input attached to the engine output and an output; a drive shaft rotatably disposed in the vertical drive housing and having an input end attached to the transmission output and an output end; and a propeller attached to the drive shaft output end.

BRIEF DESCRIPTION OF THE DRAWINGS

The features and advantages of the present invention will become apparent from the following detailed description of the invention when read with the accompanying drawings. Similar parts appearing in multiple figures may be numbered consistently among the figures, in which.

DETAILED DESCRIPTION OF THE INVENTION

Figure 1:
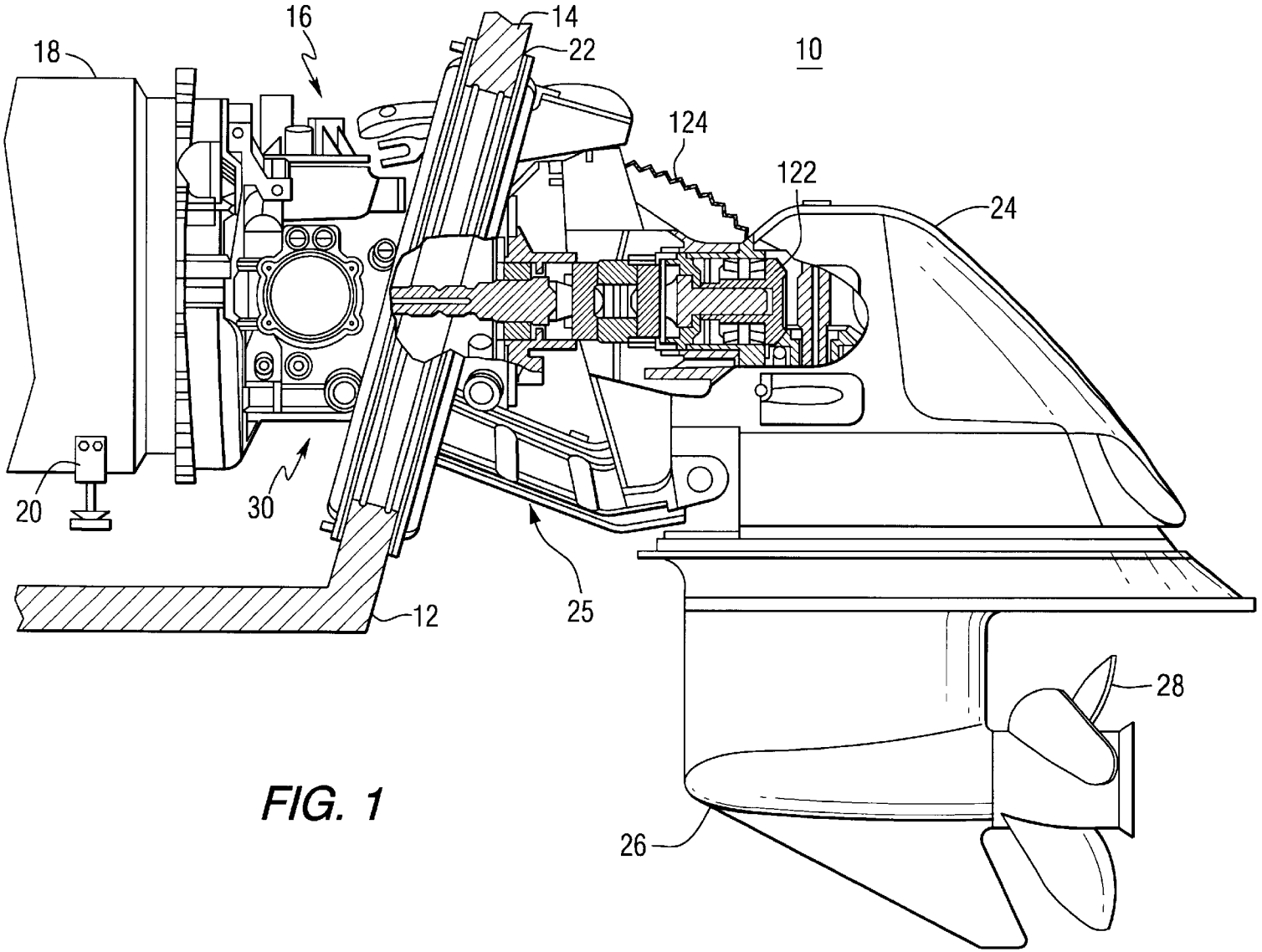
FIG. 1 is a partial sectional view of a watercraft having an in-board/out-board propulsion system including a two-speed transmission with reverse gearing disposed in the gimbal housing passing through the transom of the watercraft.

FIG. 1 illustrates a watercraft 10 having a hull 12 including a transom 14. A marine propulsion apparatus 16 for the watercraft 10 includes an engine 18 attached to the hull 12 by one or more engine mounts 20 as is customary in the art. Attached to the engine 18 and extending through an opening 22 in transom 14 is gimbal housing 25 which forms a part of and is the housing for a multi-speed automatic transmission 30. A vertical drive housing 24 is pivotally attached to an outboard portion of gimbal housing 25 and includes a torpedo section 26 disposed ahead of a propeller 28. The gimbal housing 25 and the vertical drive housing 24 together are referred to as a stern drive unit. The vertical drive housing 24 may be rotated about both vertical and horizontal axes for steering and trimming the watercraft and for raising the propeller 28 to an uppermost position for operation in shallow water and for ground transportation. As will be described more fully below with respect to FIGS. 2 and 3, gimbal housing 25 encloses and supports both a forward-reverse shifting apparatus 42 and first-second gear shifting apparatus 78. By incorporating a multi-speed transmission with reverse gearing into the gimbal housing 25, the propulsion apparatus 16 is adapted to be used in place of a standard single speed inboard/outboard marine propulsion system. The inventor has found that by using two sets of planetary gears having a common ring gear, that a two-speed transmission with reverse gearing capability may be provided as a very compact unit, thus permitting it to be packaged within the space provided by the gimbal housing of an inboard/outboard marine propulsion unit.

Figure 2:
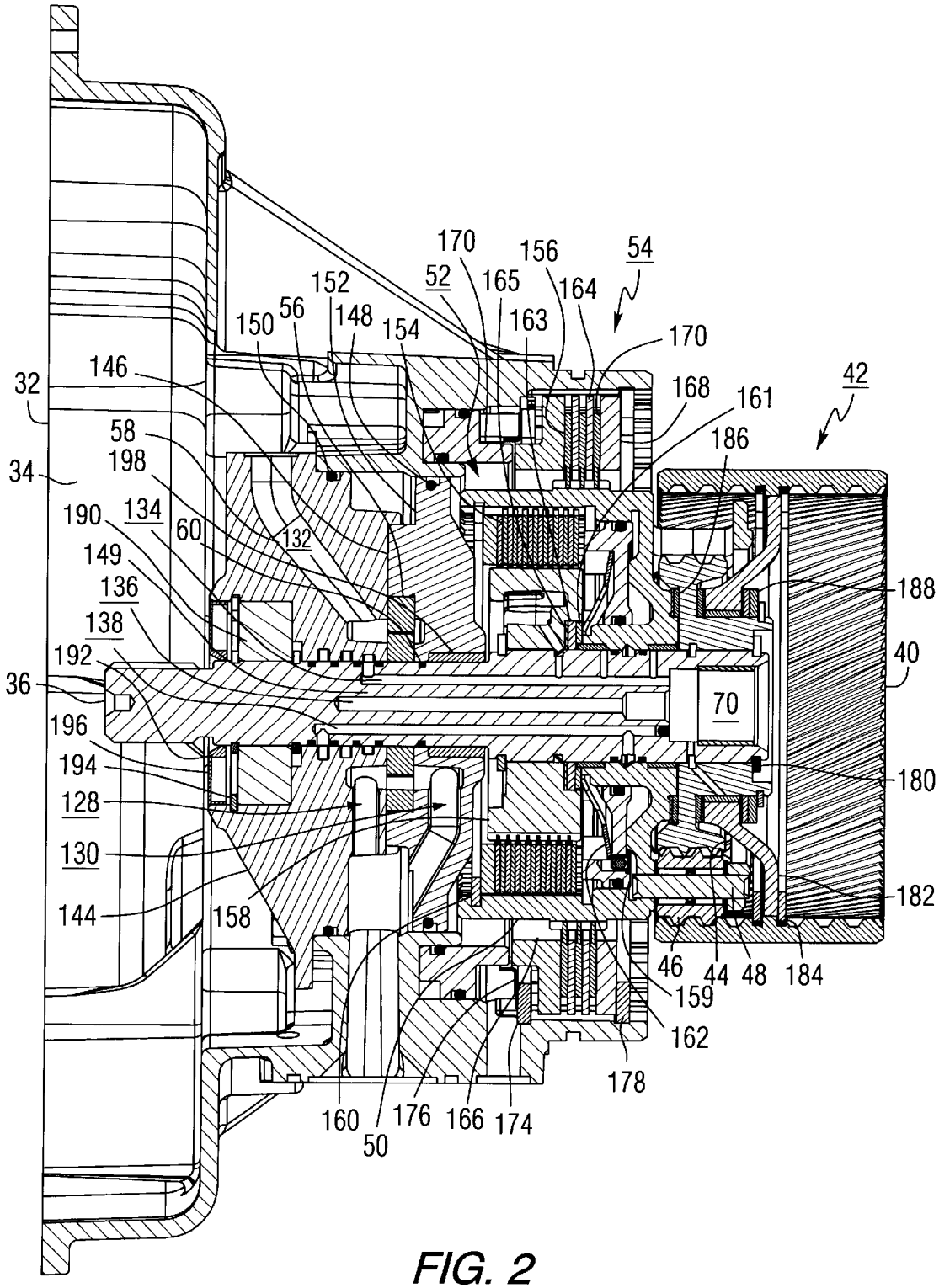
FIG. 2 is a partial sectional view of a forward-reverse housing portion of one embodiment of a transmission that may be used in the watercraft of FIG. 1.

FIG. 2 is a partial cross-sectional view of one embodiment of transmission 30 as may be used for watercraft 10. Transmission 30 includes a forward-reverse housing 32 which may form a forward inboard portion of gimbal housing 25 of FIG. 1. Housing 32 is adapted to be attached to engine 18 and is formed to fit around the engine output flywheel 34. An input shaft 36 is rotatably supported within the housing 32 by one or more bearings 38. Input shaft 36 is mechanically connected to and concentric with flywheel 34 for conveying mechanical energy into the transmission 30 via rotation with the output 34 of engine 18. Mechanical energy is conveyed out of the forward-reverse housing 32 via a forward-reverse housing output such as ring gear 40, which is operatively engaged with input shaft 36. A forward-reverse shifting apparatus 42 is supported by housing 32 for selective engagement between the input shaft 36 and the output ring gear 40 in one of a forward and a reverse direction. Forward-reverse shifting apparatus 42 includes a sun gear 44 attached to and concentric with the input shaft 36 for rotation therewith, and one or more first planetary gears 46 engaged between the first sun gear 44 and the ring gear 40. Planetary gears 46 are disposed between the first sun gear 44 and the ring gear 40 about the axis of rotation of input shaft 36, as is in known in the art of planetary gears. Each of the planetary gears 46 is rotatable about an axis of rotation 48 that is supported by a carrier 50. Carrier 50 is supported for rotation about input shaft 36 by bushings. Forward-reverse shifting apparatus 42 also includes a forward gear clutch 52 disposed between the input shaft 36 and the carrier 50. Forward gear clutch 52 may be any design clutch known in the art, and may be a hydraulically actuated clutch operable for selective engagement and disengagement between input shaft 36 and carrier 50. A reverse gear clutch 54 is disposed between the carrier 50 and the housing 32 and is operable for selective engagement therebetween.

Forward-reverse shifting apparatus 42 is operable to engage input shaft 36 to ring gear 40 for rotation of ring gear 40 alternatively in a forward direction or in a reverse direction. For forward operation, forward gear clutch 52 is engaged to prevent relative movement between the carrier 50 and the input shaft 36, and reverse gear clutch 54 is disengaged to allow relative movement between the carrier 50 and the housing 32. The engagement and disengagement of the clutches may be controlled by alternatively connecting and disconnecting a supply of pressurized hydraulic fluid, as will be described more fully below. The rotation of input shaft 36 will thereby cause the axis of rotation 48 of planetary gear 46 to rotate with sun gear 44. As is known in the art of planetary gears, by locking the relative positions of the sun gear 44 and planetary gears 46, ring gear 40 is caused to rotate in the same direction as input shaft 36, i.e. in a forward direction. For reverse operation, forward gear clutch 52 is released to allow input shaft 36 to rotate relative to carrier 50, and reverse gear clutch 54 is engaged to affix carrier 50 relative to housing 32. With carrier 50 in a fixed position, planetary gears 46 are free to rotate about their respective axes of rotation 48 in response to the rotation of input shaft 36 and its attached first sun gear 44. Due to the rotation of planetary gears 46 about their axis of rotation 48, ring gear 40 is caused to rotate in a direction opposite to that of input shaft 36, i.e. in a reverse direction. It may be appreciated that in the forward direction, the rate of rotation of ring gear 40 will be equal to the rate of rotation of input shaft 36. However, in the reverse direction, the rate of rotation of ring gear 40 may be a ratio of the rate of rotation of input shaft 36 due to the action of the planetary gear set 44,46,40. A predetermined gearing ratio in the reverse direction may be selected to provide ring gear 40 with a desired higher rate of rotation in the reverse direction, such as a 1.5:1 ratio, for example.

FIG. 2 also illustrates a geroter pump 56 attached to input shaft 36. Geroter pump 56 provides hydraulic fluid at an elevated pressure through output 58. One such geroter pump known in the art is provided by Nichols Portland, Inc. Pressurized hydraulic fluid provided by pump 56 may be utilized to operate first and second gear clutches 52, 54. One or more seal rings 60 may be provided on input shaft 36 on one or both sides of geroter pump 56 in order to limit the leakage from the pump and thereby to improve the low speed performance of pump 56.

Figure 3:
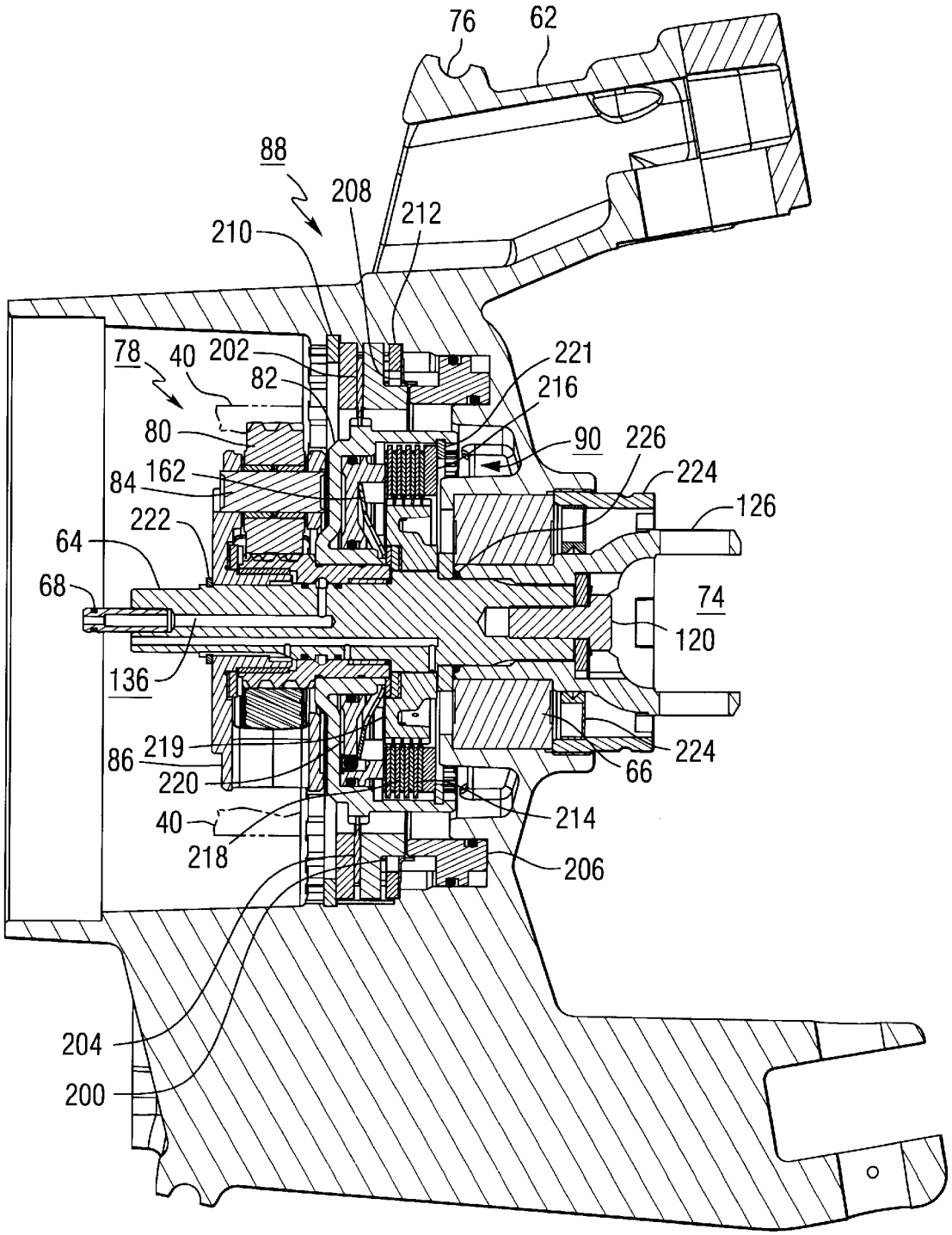
FIG. 3 is a partial sectional view of a first-second gear housing portion of a transmission that may be coupled to the forward-reverse housing portion of FIG. 2.

FIG. 3 illustrates a partial cross-sectional view of a first-second gear portion of transmission 30 showing first-second gear housing 62 which is adapted for connection to the forward-reverse housing 32 illustrated on FIG. 2. An output shaft 64 is rotatably supported within housing 62 by one or more bearings, such as double ball bearing 66. Output shaft 64 has an input end 68 operable to be journalled to an output end 70 of input shaft 36, as illustrated on FIG. 2, for providing additional support between the shafts when housing 32 is connected to housing 62. Output shaft 64 is connected at its output end 72 to a double universal joint 74, as will be described more fully below. Housing 62 is adapted to extend through opening 22 of transom 14 as illustrated on FIG. 1. A transom seal flange 76 is adapted for connection to a flexible boot (not shown) for providing a water tight seal between first-second gear housing 62 and transom 14.

Gimbal housing 25 and vertical drive housing 24 are supported in cantilever fashion from engine 18, as shown in FIG. 1. Because it is flexible, the boot forming the water tight seal between the propulsion apparatus 16 and the transom 14 is not capable of carrying any substantial support load. Thus, the stern drive unit is effectively isolated from the hull 12 by its support through the engine 18 and engine mounts 20.

A first-second gear shifting apparatus 78 is disposed within housing 62 for providing a selective gearing connection between output shaft 64 and ring gear 40. Ring gear 40 is illustrated in phantom in FIG. 3 to illustrate its position when housing 62 is attached to housing 32. Ring gear 40 provides a mechanical energy input through forward-reverse housing 32 from engine 18. A second planetary gear 80 is engaged between ring gear 40 and a second sun gear 82 to form a planetary gear set for providing multi-speed capability for transmission 30. One or a plurality of second planetary gears 80 are supported for rotation about their respective axes of rotation 84 by a carrier 86 which is attached to and rotates with output shaft 64. A first gear clutch 88 is positioned for selective engagement between second sun gear 82 and housing 62. A second gear clutch 90 is positioned for selective engagement between second sun gear 82 and output shaft 64. Thus by selectively engaging and disengaging clutches 88, 90, sun gear 82 may be made free to rotate concentrically about output shaft 64 or to be locked into a fixed position around output shaft 64.

Mechanical energy from engine 18 is delivered in the form of forward or a reverse direction rotation of ring gear 40, as described above. For first gear operation, first gear clutch 88 is engaged to prevent the relative movement of sun gear 82 with respect to housing 62, while second gear clutch 90 is disengaged to permit the rotation of output shaft 64 within second sun gear 82. Because second sun gear 82 is in a fixed position, the rotation of ring gear 40 will induce the rotation of carrier 86 and its attached output shaft 64 due to the rotational movement of second planetary gear 80 about its axis of rotation 84. The direction of rotation of output shaft 64 will be the same as the direction of rotation of ring gear 40, however a predetermined gearing ratio, such as for example 1.33:1, will be developed through the action of the second planetary gear 80. This gearing ratio provides a low gear operating capability for transmission 30.

For operation in second gear, first gear clutch plate 88 is disengaged and second gear clutch plate 90 is engaged, thereby causing second sun gear 82 to rotate with output shaft 64. In this alignment, because carrier 86 is attached for rotation with output shaft 64, the rotation of ring gear 40 will cause the coupled rotation of second planetary gear 80, second sun gear 82, and output shaft 64 in the same direction and at the same speed as ring gear 40.

In one embodiment, first-second gear shifting apparatus 78, or alternatively a much simpler mechanism not having planetary gears or clutches, is locked in the second gear configuration to provide a direct drive connection between ring gear 40 and output shaft 64. For example, a single gear attached to output shaft 64 and engaging ring gear 40 may be used to replace second sun gear 82, second planetary gear 80 and clutches 88,90. Such an embodiment may be a lower cost option for a watercraft 10 where first-second gear transmission capability is not provided. This may be especially useful where the gimbal housing 24 is provided as having two portions 32,62. First-second gear housing 62 may be provided in a one speed form without first-second gear shifting apparatus 78 or in a two-speed form with first-second gear shifting apparatus 78. Shifting apparatus 78 may optionally be added at a later date, either as a gearing kit or as a complete first-second gear housing unit.

Figure 4:
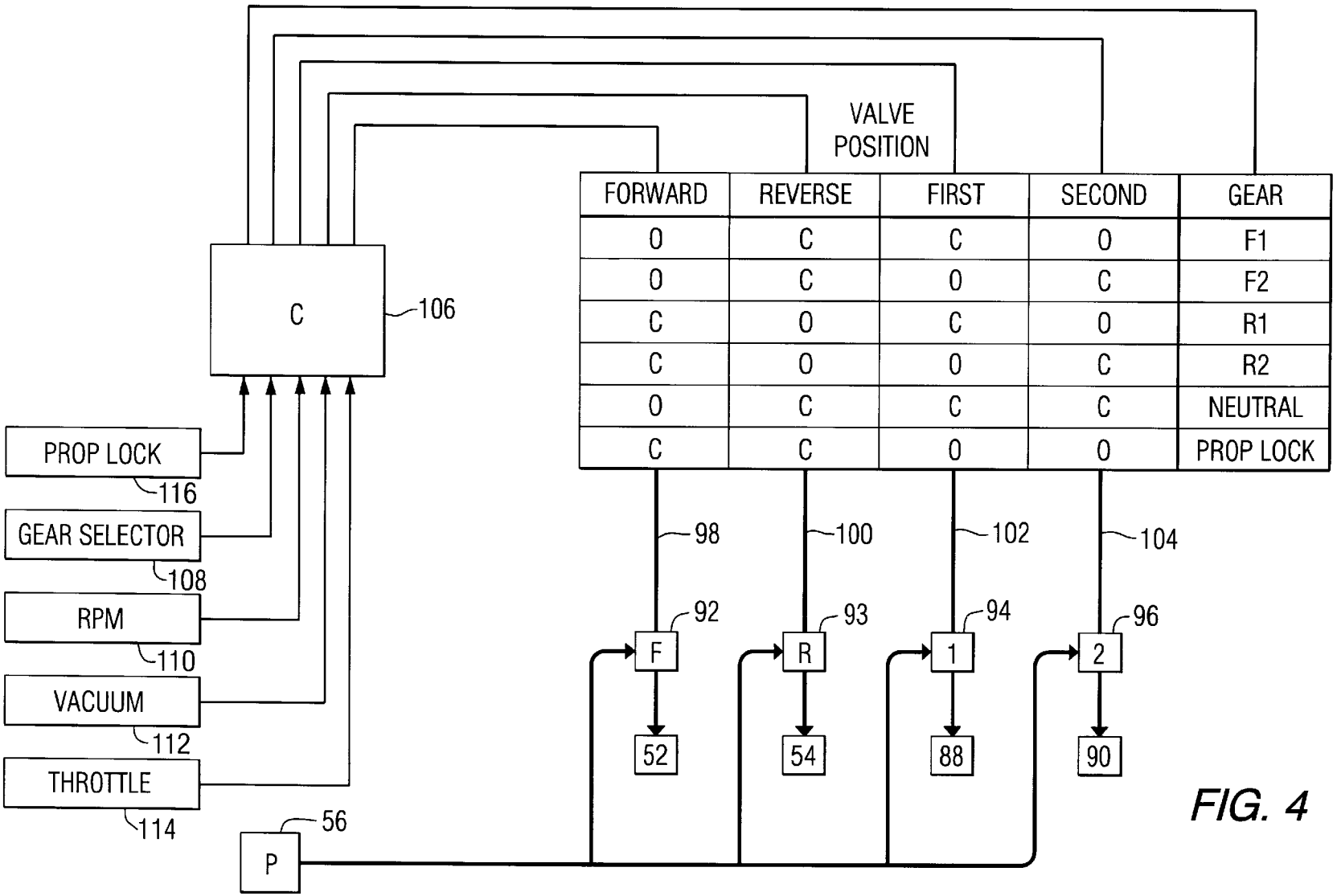
FIG. 4 is a schematic illustration of a shift control apparatus that may be used to control the shifting of the transmission of FIGS. 1 and 2.

FIG. 4 is a schematic illustration of a control system for the transmission 30 of FIGS. 2 and 3. Pump 56 provides pressurized hydraulic fluid to clutches 52, 54, 88, 90 through respective valves 92, 93, 94, 96. The control of pressurized hydraulic fluid to each clutch is preferably controlled independently, with a valve aligned with each respective clutch plate. Valves 92, 93, 94, 96 may be any type of valve known in the art of hydraulic fluid control, such as a mechanical rotor valve or an electrical solenoid valve. Depending upon the desired control scheme, the function of any two of the valves may be provided by a double acting solenoid valve operable to provide pressurized hydraulic fluid from pump 56 alternatively to either of two clutches. Valves 92, 93, 94, 96 are controlled by control signals 98, 100, 102, 104 respectively. The control signals are generated by controller 106 in response to pre-programmed logic operating on predetermined input signals. Controller 106 may be any controller known in the art, such as a microprocessor, personal computer, or even a mechanical device. Controller 106 is illustrated as a microprocessor containing logic operative to receive as inputs a gear selector signal 108, an engine speed signal 110, an engine vacuum signal 112, a throttle position signal 114, and/or a propeller lock signal 116. Any one or more of these inputs may be used and processed by any desired logic to provide a desired shifting pattern. Logic within controller 106 is operable to select the appropriate gear and to generate appropriate valve control signals 98, 100, 102, 104 in response to the various input signals. For example, when the gear selector signal 108 indicates that the operator desires to move the watercraft 10 in a forward direction, and the engine speed signal 110, vacuum signal 112, and throttle position signal 114 indicate that the watercraft is accelerating from a slow speed, logic within controller 106 may select the forward-first gear for transmission 30. Accordingly, clutches 52, 90 must be moved to the engaged position and clutches 54, 88 must be moved to the disengaged position. To achieve this configuration, controller 106 will generate appropriate output signals 98, 100, 102, 104 to position valves 92, 93, 94, 96 accordingly. Various other combinations of such signals may be generated when appropriate to place the transmission 30 into other gears, as illustrated in the following matrix of valve positions.

| GEAR | Valve 92 | Valve 93 | Valve 94 | Valve 96 |
|---|---|---|---|---|
| first forward | open | closed | closed | open |
| second forward | open | closed | open | closed |
| first reverse | closed | open | closed | open |
| second reverse | closed | open | open | closed |
| neutral | open | closed | closed | closed |
| prop lock | closed | closed | open | open |

The "prop lock" gear refers to a gear where the propeller 28 is locked to prevent its rotation even with the engine 18 operating. Many prior art marine transmissions cause the propeller to rotate slowly when the transmission is in a neutral position. This unintended propeller rotation is the result of various mechanical interferences and hydraulic couplings acting through the transmission when it is in a neutral position. While the propeller will generally rotate at a speed slower than the engine idle speed, even such a slow movement of the propeller is sufficient to propel a watercraft through the water. Controller 106 may be programmed to mechanically lock the propeller 28 in relation to hull 12 when transmission 30 is in either a neutral or a special Propeller Lock position. In such a configuration, signals 98, 100, 102, 104 are generated to position valves 92, 93, 94, 96 to provide pressurized hydraulic fluid to each of clutches 88 and 90 but not to clutches 52 and 54. In this manner, output shaft 64 is mechanically affixed to housing 62 through second sun gear 82, as illustrated in FIG. 3, and ring gear 40 is free to rotate with the engine 18.

In one embodiment, a single rotary spool valve may be used to provide the functions of valves 92,93 to engage and disengage forward clutch 52 and reverse clutch 54, together with a single two-position double acting spring loaded solenoid valve to provide the functions of valves 94,96 to engage and disengage first gear clutch 88 and second gear clutch 90. The solenoid is preferably spring biased toward the second gear position so that in the event of an electrical failure, the transmission will stay in second (higher) gear.

Referring again to FIG. 3, it can be seen that double universal joint 74 is affixed at one end to output shaft 64 by fastener 120 threadably engaged with the output end 72 of output shaft 64. The opposed end of universal joint 74 is inserted into and splined to a portion of a drive shaft 122 which is rotatably supported within vertical drive housing 24, as illustrated in FIG. 1. The drive shaft 122 may include one or more gears for transferring power from the universal joint 74 to propeller 28. A flexible bellows 124 is sealingly attached to both the vertical drive housing 24 and the gimbal housing 24 in order to prevent water from coming into contact with universal joint 74. In the event that the universal joint 74 must be replaced, as sometimes happens due to the leakage of water past bellows 124, such replacement may be conveniently accomplished without the removal of the gimbal housing 24 or any of the associated parts of transmission 30. Once the vertical drive housing 24 is detached from first housing 62, the universal joint 74 may be partially disassembled to provide access to fastener 120. Fastener 120 is then removed to allow removal of the remainder of the yoke 126 of universal joint 74 and the installation of the replacement part.

Referring again to FIG. 2, it can be seen that hydraulic fluid is drawn from a sump (not shown) to both sides of the inlet of gerotor pump 56 by passages 128, 130. Pressurized hydraulic fluid is directed away from the pump outlet by passage 132 toward valves 92, 93, 94, 96 which may be mounted atop the housing 32. A plurality of channels are shown to be formed in input shaft 36 for the passage of pressurized hydraulic fluid. A first channel 134 directs pressurized hydraulic fluid to a plurality of outlets associated with the various gears of forward-reverse shifting apparatus 42. A second channel 136 extending into output shaft 64 directs pressurized hydraulic fluid to second gear clutch 90, and a third channel 138 directs pressurized hydraulic fluid to forward clutch assembly 52. Additional channels are formed in front bearing housing 144 which forms one half of the housing for geroter pump 56. The second half of the pump housing is formed by plate 146. Front bearing housing 144 and plate 146 are sealed against outer housing 32 by O-rings 148, 150. Item 149 indicates the location of a drive key on shaft 36 for gerotor pump 56, although the drive key is not visible in the view of FIG. 2.

Forward clutch assembly 52 includes clutch disks 152, 154 and friction disk 156 which are urged together against hub 158 by piston 159. Retaining ring 160 provides the reaction force for the forward clutch assembly 52. Spring 162, supported by retaining ring 161, thrust bearing 163, and thrust washer 165, provides the return force to release the clutch when pressure is removed.

Reverse clutch assembly 54 includes clutch disks 164, 166, 168 and friction disk 170 urged together by piston 172. Retaining ring 174 provides the reaction force for return spring 176, and retaining ring 178 retains the opposed side of the clutch assembly.

Sun gear 40 is retained on input shaft 36 by retaining ring 180. Axial loads transmitted through retaining ring 184 from ring gear 40 are reacted by hub and bushing assembly 182. A thrust bearing 186 is located on each side of sun gear 40, with thrust washer 188 being interposed between thrust bearing 186 and retaining ring 180.

Ball bearing 190 is held in position against input shaft 36 by retaining rings 192 and against front bearing housing 144 by retaining ring 194. Oil seal 196 provides a seal between the shaft 36 and housing 36. Needle bearing 198 provides additional support for shaft 36 against plate 146. Other various seal rings and O-rings can be seen in FIG. 2 for providing appropriate protection against leakage and pressure boundaries for the pressurized hydraulic fluid.

Referring again to FIG. 3, it can be seen that first gear clutch assembly 88 includes clutch disks 200, 202 and friction disk 204 urged together by piston 206. Spring assembly 208, supported by retaining rings 210, 212, provides a return force for releasing the clutch when hydraulic pressure is released. Clutch disk 200 is made to be L-shaped to provide room for locating spring assembly 208.

Second gear clutch assembly 90 includes clutch disks 214, 216 and friction disk 218, urged together between hub 219 and retaining ring 221 by piston and check valve assembly 220. The check valve portion of piston and check valve assembly 220 allows the pressurized hydraulic fluid to drain out of the piston once it has been depressurized.

First-second shifting apparatus is retained on output shaft 64 by retaining ring 222. Seal 224 provides an oil barrier between yoke 126 and bearing retainer 224, while O-ring 226 seals the opposed side of yoke 126 against shaft 64. Other various seal rings and O-rings can be seen in FIG. 3 for providing appropriate protection against leakage and pressure boundaries for the pressurized hydraulic fluid.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

I claim as my invention:

1. A transmission for a watercraft comprising:

a housing;

an input shaft rotatably supported by the housing;

an output shaft rotatably supported by the housing;

a first gear attached to and concentric with the input shaft for rotation therewith;

a ring gear;

a first planetary gear engaged between the first sun gear and the ring gear, the first planetary gear having an axis of rotation affixed to a carrier;

a forward clutch disposed between the input shaft and the carrier and operable for selective engagement therebetween;

a reverse clutch disposed between the housing and the carrier and operable for selective engagement therebetween;

a second sun gear;

a second planetary gear engaged between the second sun gear and the ring gear, the second planetary gear attached to the output shaft for rotation therewith;

a first gear clutch disposed between the second sun gear and the housing and operable for selective engagement therebetween; and a second gear clutch disposed between the output shaft and the sun gear for selective engagement therebetween.

2. The transmission of claim 1, further comprising:

a geroter pump attached to the input shaft for providing pressurized hydraulic fluid to each of the forward clutch, reverse clutch, first gear clutch and second gear clutch, and a valve in fluid communication between the geroter pump and each of the forward clutch, reverse clutch, first gear clutch and second gear clutch for controlling the selective engagement of the respective clutch.

3. The transmission of claim 2, further comprising:

a double acting solenoid valve in fluid communication between the geroter pump and each of the forward clutch and the reverse clutch for alternatively selecting engagement of one of the forward clutch and the reverse clutch.

4. The transmission of claim 2, further comprising:

a controller connected to each respective valve for controlling the selective engagement of each respective clutch.

5. The transmission of claim 4, further comprising logic in the controller operable to simultaneously engage the first gear clutch and the second gear clutch and to disengage the forward clutch and the reverse clutch.

6. The transmission of claim 2, further comprising at least one seal ring disposed to be in sealing contact with the input shaft proximate the geroter pump.

7. The transmission of claim 1, further comprising:

the input shaft having an input end adapted for connection to an engine and an output end;

the output shaft having an output end adapted for connection to a propeller and an input end;

the input end of the output shaft being journalled to the output end of the input shaft.

8. The transmission of claim 2, further comprising:

a double acting solenoid valve in fluid communication between the geroter pump and each of the first gear clutch and the second gear clutch for alternatively selecting engagement of one of the first gear clutch and the second gear clutch;

wherein the double acting solenoid valve is spring biased toward the second gear position.

9. A transmission for a marine stern drive propulsion apparatus, the transmission comprising:

a first housing adapted for attachment to an engine;

an input shaft rotatably supported by the first housing;

a first sun gear attached to and concentric with the input shaft for rotation therewith;

a ring gear;

a first planetary gear engaged between the first sun gear and the ring gear, the first planetary gear having a axis of rotation affixed to a carrier;

a forward clutch disposed between the input shaft and the carrier and operable for selective engagement therebetween;

a reverse clutch disposed between the housing and the carrier and operable for selective engagement therebetween;

a second housing adapted for attachment to the first housing;

an output shaft rotatably supported by the second housing and adapted for connection to a propeller drive shaft, the output shaft connected to the ring gear for rotation therewith.

10. The transmission of claim 9, further comprising:

a second sun gear;

a second planetary gear engaged between the second sun gear and the ring gear, the second planetary gear having an axis of rotation attached to the output shaft for rotation therewith;

a first gear clutch disposed between the sun gear and the housing and operable for selective engagement therebetween;

a second gear clutch disposed between the output shaft and the sun gear for selective engagement therebetween.

11. A transmission for a marine stern drive propulsion apparatus, the transmission comprising:

a first housing adapted for attachment to a motor;

an input shaft rotatably supported by the first housing;

a first housing output gear rotatably supported by the first housing;

a forward-reverse shifting apparatus supported in the first housing for selective engagement between the input shaft and the first housing output gear in one of a forward and a reverse directions;

a second housing attached to the first housing;

an output shaft rotatably supported by the second housing;

a connection between the first housing output gear and the output shaft for providing rotation of the output shaft in response to rotation of the first housing output gear.

12. The transmission of claim 11, wherein the connection between the first housing output gear and the output shaft further comprises a first-second gear shifting apparatus for selective engagement between the first housing output gear and the output shaft at one of a first gear ratio and a second gear ratio.

13. The transmission of claim 11, wherein the forward-reverse shifting apparatus further comprises:

a first sun gear attached to and concentric with the input shaft;

a first planetary gear engaged between the first sun gear and the first housing output gear, the first housing output gear comprising a ring gear; and wherein the connection between the first housing output gear and the output shaft further a first-second shifting apparatus comprising:

a second sun gear; and a second planetary gear having an axis of rotation attached to the output shaft, the second planetary gear engaged between the first housing output gear and the second sun gear.

14. A marine propulsion apparatus comprising:

an engine having an output;

a transmission housing attached to the engine and adapted for passing through the transom of a boat;

an input shaft rotatably supported by the transmission housing and connected to the engine output for rotation therewith;

a output shaft rotatably supported by the transmission housing;

a vertical drive housing rotatably connected to the transmission housing;

a drive shaft rotatably supported by the vertical drive housing and connected to the output shaft;

a propeller connected to the drive shaft;

a first sun gear attached to and concentric with the input shaft for rotation therewith;

a ring gear disposed in the transmission housing;

a first planetary gear engaged between the first sun gear and the ring gear, the first planetary gear having a axis of rotation affixed to a carrier;

a forward clutch disposed between the input shaft and the carrier and operable for selective engagement therebetween;

a reverse clutch disposed between the transmission housing and the carrier and operable for selective engagement therebetween;

a second sun gear disposed in the transmission housing;

a second planetary gear engaged between the second sun gear and the ring gear, the second planetary gear having an axis of rotation attached to the output shaft for rotation therewith;

a first gear clutch disposed between the sun gear and the transmission housing and operable for selective engagement therebetween;

a second gear clutch disposed between the output shaft and the sun gear for selective engagement therebetween.

15. The marine propulsion apparatus of claim 14, further comprising:

a double universal joint connected between the output shaft and the drive shaft, the double universal joint comprising a first yoke in splined connection with the output shaft; and a connector for removeably retaining the first yoke on the output shaft.

16. A marine propulsion apparatus comprising:

an engine having an output;

a first housing attached to the engine;

an input shaft rotatably supported by the first housing and connected to the engine output for rotation therewith;

a first housing output gear;

a forward-reverse shifting apparatus in the first housing for selective engagement between the input shaft and the first housing output gear in one of a forward direction and a reverse direction;

a second housing attached to the first housing;

an output shaft rotatably supported by the second housing;

a connection between the first housing output gear and the output shaft for providing rotation of the output shaft in response to rotation of the first housing output gear;

a vertical drive housing attached to the second housing;

a drive shaft rotatably supported by the vertical drive housing; and a propeller connected to the drive shaft.

17. The marine propulsion apparatus of claim 16, wherein the forward-reverse shifting apparatus further comprises:

a first sun gear attached to and concentric with the input shaft;

a first planetary gear engaged between the first sun gear and the first housing output gear, the first housing output gear comprising a ring gear;

a forward clutch disposed between the input shaft and the carrier and operable for selective engagement therebetween;

a reverse clutch disposed between the housing and the carrier and operable for selective engagement therebetween; and wherein the connection between the first housing output gear and the output shaft further comprises a first-second shifting apparatus comprising:

a second sun gear;

a second planetary gear having an axis of rotation attached to the output shaft, the second planetary gear engaged between the first housing output gear and the second sun gear;

a first gear clutch disposed between the sun gear and the housing and operable for selective engagement therebetween; and a second gear clutch disposed between the output shaft and the sun gear for selective engagement therebetween.

18. A marine propulsion apparatus comprising:

an engine having an output;

a first housing attached to the engine;

an input shaft rotatably supported by the first housing;

a first sun gear attached to and concentric with the input shaft for rotation therewith;

a ring gear;

a first planetary gear engaged between the first sun gear and the ring gear, the first planetary gear having a axis of rotation affixed to a carrier;

a forward clutch disposed between the input shaft and the carrier and operable for selective engagement therebetween;

a reverse clutch disposed between the housing and the carrier and operable for selective engagement therebetween;

a second housing adapted for attachment to the first housing;

an output shaft rotatably supported by the second housing and operatively connected to the ring gear for rotation therewith;

a vertical drive housing attached to the second housing;

a drive shaft rotatably supported by the vertical drive housing and attached to the output shaft;

a propeller connected to the drive shaft.

19. A watercraft comprising:

a hull having a transom;

an engine disposed in the hull and having an output;

a transmission housing attached to the engine;

a input shaft rotatably supported by the transmission housing and connected to the engine output;

a output shaft rotatably supported by the transmission housing;

a first sun gear attached to and concentric with the input shaft for rotation therewith;

a ring gear;

a first planetary gear engaged between the first sun gear and the ring gear, the first planetary gear having a axis of rotation affixed to a carrier;

a forward clutch disposed between the input shaft and the carrier and operable for selective engagement therebetween;

a reverse clutch disposed between the transmission housing and the carrier and operable for selective engagement therebetween;

a second sun gear;

a second planetary gear engaged between the second sun gear and the ring gear, the second planetary gear attached to the output shaft for rotation therewith;

a first gear clutch disposed between the sun gear and the transmission housing and operable for selective engagement therebetween;

a second gear clutch disposed between the output shaft and the sun gear for selective engagement therebetween;

a vertical drive housing attached to the transmission housing and passing through the transom;

a drive shaft rotatably supported by the vertical drive housing and connected to the output shaft;

a propeller connected to the drive shaft.

20. The watercraft of claim 19, further comprising:

a geroter pump attached to the input shaft for providing pressurized hydraulic fluid to each of the forward clutch, reverse clutch, first gear clutch and second gear clutch, and a valve in fluid communication between the geroter pump and each of the forward clutch, reverse clutch, first gear clutch and second gear clutch for controlling the selective engagement of the respective clutch.

21. The watercraft of claim 20, further comprising a controller connected to each respective valve for controlling the selective engagement of each respective clutch.

22. The watercraft of claim 21, further comprising logic in the controller operable to simultaneously engage the first gear clutch and the second gear clutch and to disengage the forward clutch and the reverse clutch, thereby locking the position of the propeller in relation to the position of the hull while allowing the engine output to rotate in relation to the hull.

23. A watercraft comprising:

a hull having a transom;

an engine disposed in the hull and having an output;

a first housing attached to the engine;

an input shaft rotatably supported by the first housing and attached to the engine output for rotation therewith;

a first housing output gear;

a forward-reverse shifting apparatus disposed in the first housing for selective engagement between the input shaft and the first housing output gear in one of a forward direction and a reverse direction;

a second housing attached to the first housing an passing through an opening in the transom;

an output shaft rotatably disposed in the second housing;

a first-second gear shifting apparatus connected between the first housing output gear and the output shaft for providing rotation of the output shaft in response to rotation of the first housing output gear at a selected one of a first gear ratio and a second gear ratio;

a vertical drive housing attached to the second housing;

a drive shaft rotatably supported by the vertical drive housing; and a propeller connected to the drive shaft.

24. The watercraft of claim 23, wherein the forward-reverse shifting apparatus further comprises:

a first sun gear attached to and concentric with the input shaft;

a first planetary gear engaged between the first sun gear and the first housing output gear, the first housing output gear comprising a ring gear;

a forward clutch disposed between the input shaft and the carrier and operable for selective engagement therebetween;

a reverse clutch disposed between the housing and the carrier and operable for selective engagement therebetween.

25. The watercraft of claim 24, wherein the first-second gear shifting apparatus comprises:

a second sun gear in the second housing; and a second planetary gear having an axis of rotation attached to the output shaft, the second planetary gear engaged between the ring gear and the second sun gear;

a first gear clutch disposed between the sun gear and the housing and operable for selective engagement therebetween;

a second gear clutch disposed between the output shaft and the sun gear for selective engagement therebetween.

26. A watercraft comprising:

a hull having a transom;

an engine disposed within the hull and having an output;

a gimbal housing attached to the engine and passing through the transom;

a vertical drive housing rotatably attached to the gimbal housing;

a transmission comprising a first-second gear shifting apparatus disposed within the gimbal housing, the transmission having an input attached to the engine output and an output;

a drive shaft rotatably disposed in the vertical drive housing and having an input end attached to the transmission output and an output end;

a propeller attached to the drive shaft output end.

27. The watercraft of claim 26, wherein the transmission comprises a first-second gear shifting apparatus and forward-reverse shifting apparatus.

28. The watercraft of claim 26, further comprising:

a double universal joint connecting the drive shaft input end and the transmission output, the double universal joint having a transmission end shaft connected to the transmission output; and a connector for removeably retaining the transmission end shaft in contact with the transmission output.

* * * * *